US009849366B1

(12) United States Patent
Thornbury

(10) Patent No.: US 9,849,366 B1
(45) Date of Patent: Dec. 26, 2017

(54) COLLAPSIBLE CARRYING CASE COVER FOR A SNOWBOARD OR SIMILAR DEVICE

(71) Applicant: David Thornbury, Phoenixville, PA (US)

(72) Inventor: David Thornbury, Phoenixville, PA (US)

( * ) Notice: Subject to any disclaimer, the term of this patent is extended or adjusted under 35 U.S.C. 154(b) by 0 days.

(21) Appl. No.: 15/255,217

(22) Filed: Sep. 2, 2016

Related U.S. Application Data

(60) Provisional application No. 62/354,934, filed on Jun. 27, 2016.

(51) Int. Cl.
*A63C 11/02* (2006.01)
*A45F 3/04* (2006.01)

(52) U.S. Cl.
CPC ..... *A63C 11/023* (2013.01); *A45F 3/04* (2013.01)

(58) Field of Classification Search
CPC ..... A45C 11/00; A45C 11/02; A45C 11/023; A45C 11/027; A45F 3/00; A45F 3/02; A45F 3/04; A45F 2200/05; A63C 11/00; A63C 11/02; A63C 11/023; A63C 11/027; B63B 35/7933; B63B 35/7946; B65D 65/02; B65D 85/00; B65D 85/20; B65D 85/30
USPC ..... 206/315.1; 150/154; 280/809–815
See application file for complete search history.

(56) References Cited

U.S. PATENT DOCUMENTS 5,163,550 A * 11/1992 Hawk ..... B63B 35/7946 206/315.1
5,967,314 A 10/1999 McGovern
D490,491 S 5/2004 Goa
6,736,263 B1 * 5/2004 Smith ..... A63C 11/02 150/154
7,374,207 B2 * 5/2008 McCoy ..... A63C 11/027 280/809
D643,493 S 8/2011 Nickolaisen
2006/0006634 A1 * 1/2006 Packer ..... A63C 11/027 280/809
2012/0006454 A1 * 1/2012 Jenkins ..... B63B 35/7933 150/154
2015/0136284 A1 * 5/2015 Haza ..... A63C 11/027 150/154

FOREIGN PATENT DOCUMENTS

CA 2498753 A1 * 9/2006 ..... A63C 11/027
WO WO 02072214 A1 * 9/2002 ..... A63C 11/027

* cited by examiner

*Primary Examiner* — Bryon Gehman
(74) *Attorney, Agent, or Firm* — Volpe & Koenig, P.C.

(57) ABSTRACT

A collapsible carrying case cover for use with board sports equipment having an expanded configuration and a fully collapsed configuration is described. The collapsible carrying case cover includes a cover that is configured to completely cover a bottom surface and edges of the board sports equipment and partially cover a top surface of the board. A peripheral edge continuously extends around the periphery of the cover and forms a channel that houses an elastic cord. The elastic cord is configured to draw the peripheral edge inwardly when in assembled relation to the board sports equipment. The cover may be held in place by a hook and loop type strap. The collapsible carrying case cover also includes a plurality of carrying handles and straps to facilitate multiple carrying modes. The collapsible carrying case cover is collapsible into a fully collapsed configuration when in unassembled relation to the board sports equipment.

7 Claims, 6 Drawing Sheets

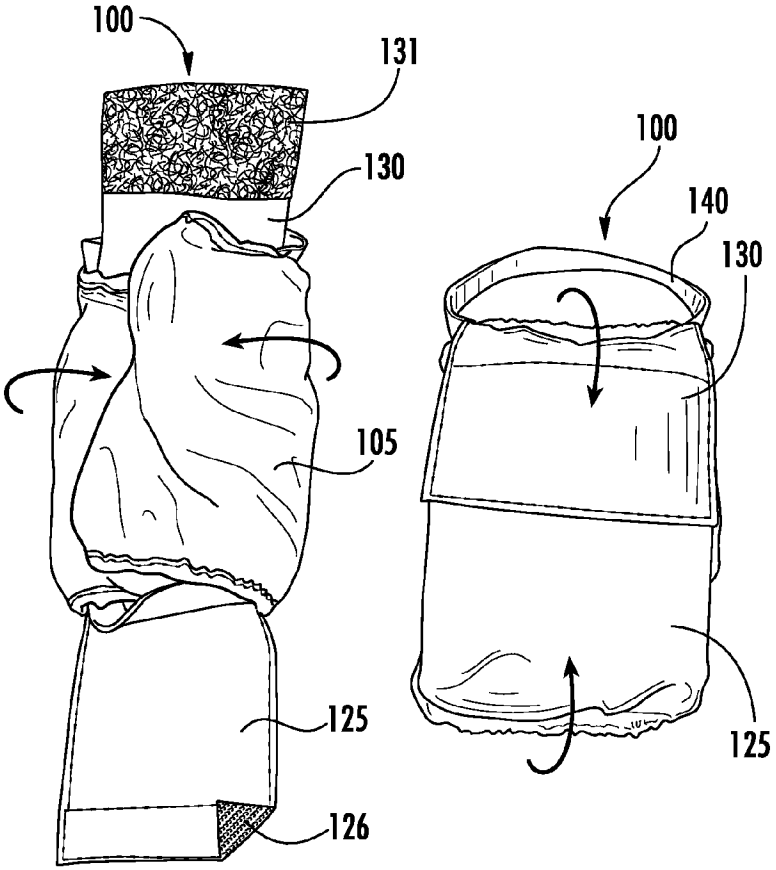
FIG. 7
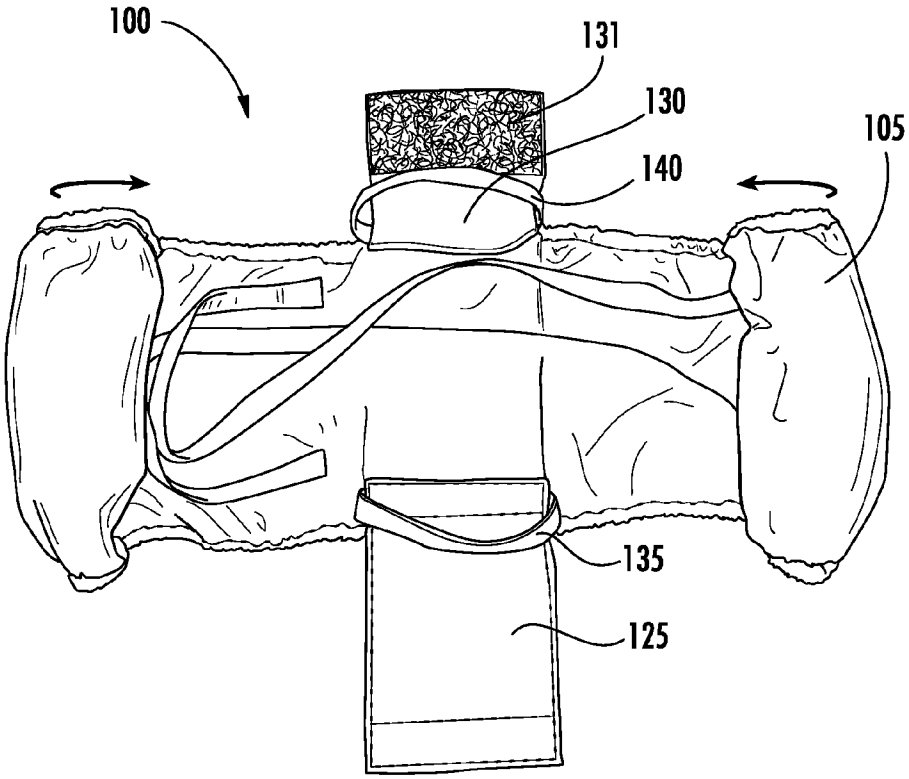
FIG. 6
FIG. 8

COLLAPSIBLE CARRYING CASE COVER FOR A SNOWBOARD OR SIMILAR DEVICE

CROSS REFERENCE TO RELATED APPLICATION

This application claims the benefit of U.S. Provisional Application No. 62/354,934 filed Jun. 27, 2016, which is incorporated by reference as if fully set forth.

FIELD OF INVENTION

The invention is generally related to a collapsible carrying case cover for board sports equipment such as a snowboard, wakeboard, or similar device.

BACKGROUND

Board sports, such as snowboarding, wakeboarding, surfing, and the like are popular activities. Enthusiasts of such activities generally must travel to locations where they can engage in board sports. Board sports equipment, such as snowboards, wakeboards, surfboards, and the like can be cumbersome to transport. This is especially the case when an enthusiast uses public transportation, where luggage storage is often minimal. Board sports equipment is also susceptible to damage during transportation and may include certain features that, when unprotected, may cause damage to surfaces or fixtures that the equipment comes into contact with.

For example, the base of a snowboard requires a smooth surface free from scratches or other imperfections for optimal performance. The edges of a snowboard, which typically include a thin piece of metal, must also be free from imperfections, such as burrs, notches, or rust patches, for optimal performance. The base and edges of a snowboard are therefore susceptible to damage during transportation if left unprotected. Additionally, due to their sharp nature, the metal edges of a snowboard may slice or damage certain materials, such as those found in the interior of a vehicle or boat.

In addition, certain board sports equipment will collect water or snow after use, which may drain into unwanted areas during transportation, such as the interior of a vehicle.

Travel bags for board sports equipment exist, however they are typically bulky and designed to encase the entire board and bindings. They are often typically constructed of a thick padded material and/or a hard plastic shell. These materials are not conducive to being folded or collapsed into a smaller storable package that may stay with the user while the user engages in board sports. Thus, there is a need for a lightweight carrying case cover for board sports equipment that can be collapsed into a smaller storable unit that may stay with a user while the user engages in board sports.

SUMMARY

A collapsible carrying case cover for use with board sports equipment having an expanded configuration and a fully collapsed configuration is described. The collapsible carrying case cover includes a cover that is configured to completely cover a bottom surface and edges of the board sports equipment and partially cover a top surface of the board sports equipment. A peripheral edge continuously extends around the periphery of the cover and forms a channel that houses an elastic cord. The elastic cord is configured to draw the peripheral edge inwardly when in assembled relation to the board sports equipment. The cover may be held in place by a hook and loop type strap. The collapsible carrying case cover also includes a plurality of carrying handles and straps to facilitate multiple carrying modes. The collapsible carrying case cover is collapsible into a fully collapsed configuration when in unassembled relation to the board sports equipment.

BRIEF DESCRIPTION OF THE DRAWINGS

FIG. 6 is a top plan view of one embodiment of the present invention in unassembled relation to a snowboard in a partially rolled configuration;

FIG. 7 is a top plan view of one embodiment of the present invention in unassembled relation to a snowboard in a fully rolled configuration; and FIG. 8 is a top plan view of one embodiment of the present invention in unassembled relation to a snowboard in a fully collapsed configuration.

DETAILED DESCRIPTION OF THE PREFERRED EMBODIMENTS

Figure 1:
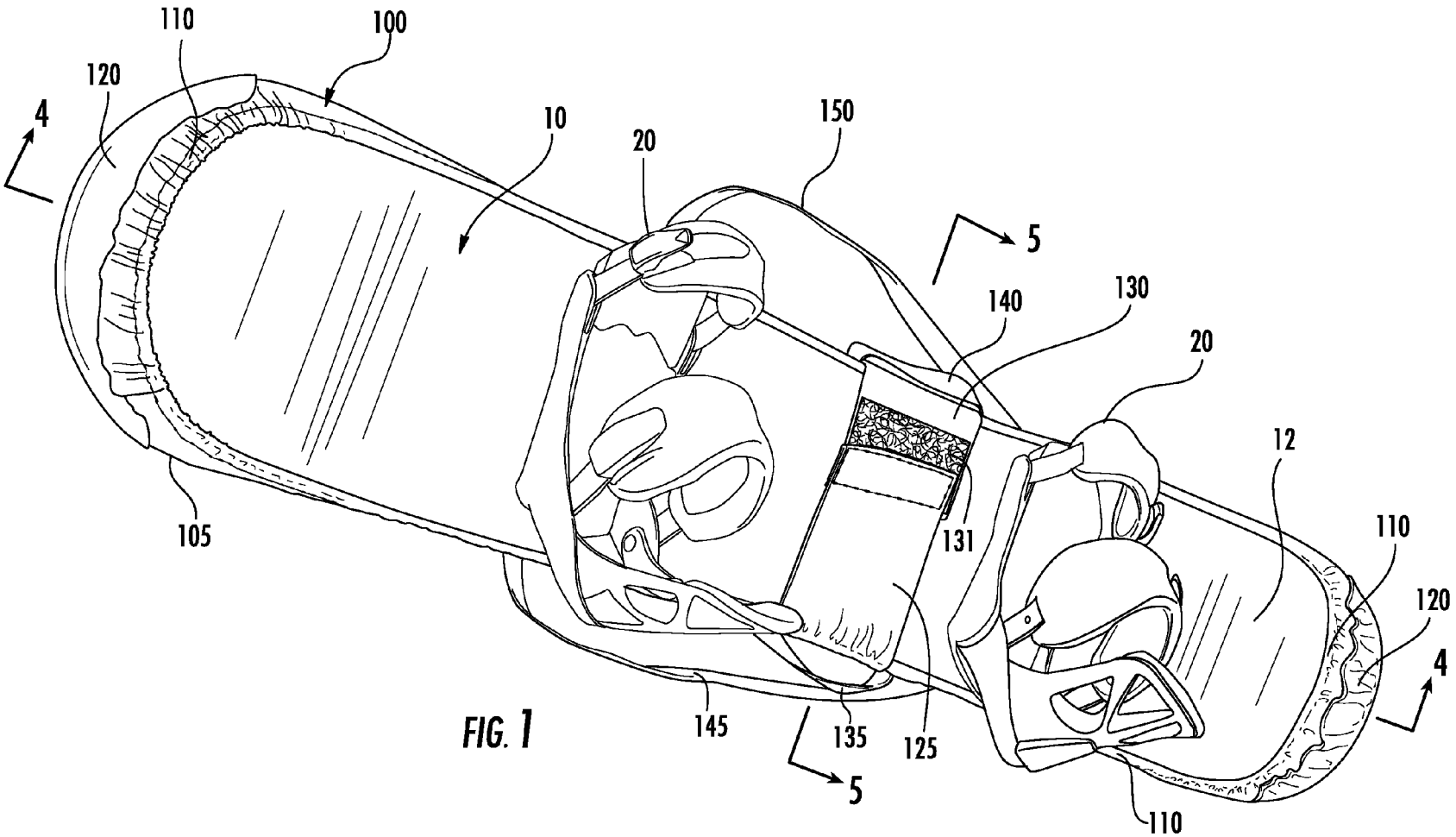
FIG. 1 is a perspective view of one embodiment of the present invention in assembled relation to a snowboard.

For the purposes of the following description, certain terminology is used in the following description for convenience only and is not limiting.

Referring to the drawings and first to FIGS. 1-5, there is illustrated one embodiment of a collapsible carrying case cover 100 in assembled relation to a snowboard 10. It should be noted that although the invention is described in relation to a snowboard, it is adaptable for use with other board sports equipment, including, but not limited to, wakeboards, surfboards, and the like.

The snowboard 10 depicted in FIGS. 1-5 is comprised of a top surface 12, a bottom surface 14, and first and second edges 16, 18. As shown in FIGS. 1-5, bindings 20 are attached to the top surface 12 of the snowboard 10. Although bindings are depicted, they are shown merely for illustration purposes; bindings are not required for the collapsible carrying case cover 100 to be applied to a snowboard. The collapsible carrying case cover 100 may be applied to a snowboard with or without bindings.

The collapsible carrying case cover 100 depicted in FIGS. 1-5 is comprised of a cover 105. The cover 105 may be constructed of fabric that can include any number of materials, or combination of materials, such as, but not limited to, spandex, polyester, neoprene, and nylon. Preferably, the cover 105 is characterized as being stretchable along both its length and width so that it may be applied to snowboards of varying sizes and still fit tightly. The cover 105 completely covers the bottom surface 14 and the first and second edges 16, 18 of the snowboard 10. In this way, the cover 105 will trap any water or snow that is on the bottom surface 14 or first and second edges 16, 18. The cover 105 partially covers the top surface 12 of the snowboard 10. The cover 105 extends upwardly and inwardly about the perimeter of the snowboard 10, and terminates into a peripheral edge 110 that continuously extends around the periphery of the cover 105. The peripheral edge 110 is formed from the cover 105 folded upon itself and attached together, forming a channel that may house an elastic cord 115, such as a bungee-type cord. The cover 105 may be attached to itself by any of a number of means, such as, but not limited to, adhesive bonding, sewing, or stapling.

When the collapsible carrying case cover 100 is in assembled relation to a snowboard 10, as shown in FIGS. 1-5, the elastic cord 115 functions to draw the peripheral edge 110 of the cover 105 inwardly, partially covering the top surface 12 of the snowboard. In this way, the cover 105 fits tightly against the top surface 12, bottom surface 14 and the first and second edges 16, 18 of the snowboard 10.

Each end of the cover 105 may be provided with an additional protective covering 120 that may provide additional protection along the edges between the top surface 12 and the bottom surface 14 of the snowboard at a toe and heel portion of the snowboard 10. The additional protective covering 120 may be constructed of fabric that can include any number of materials, or combination of materials, such as, but not limited to, Cordura, spandex, polyester, neoprene, and nylon. The additional protective covering 120 may also be constructed of a plastic material such as, but not limited to, acrylic. The additional protective covering 120 may also be constructed of a rubber or foam material.

Figure 2:
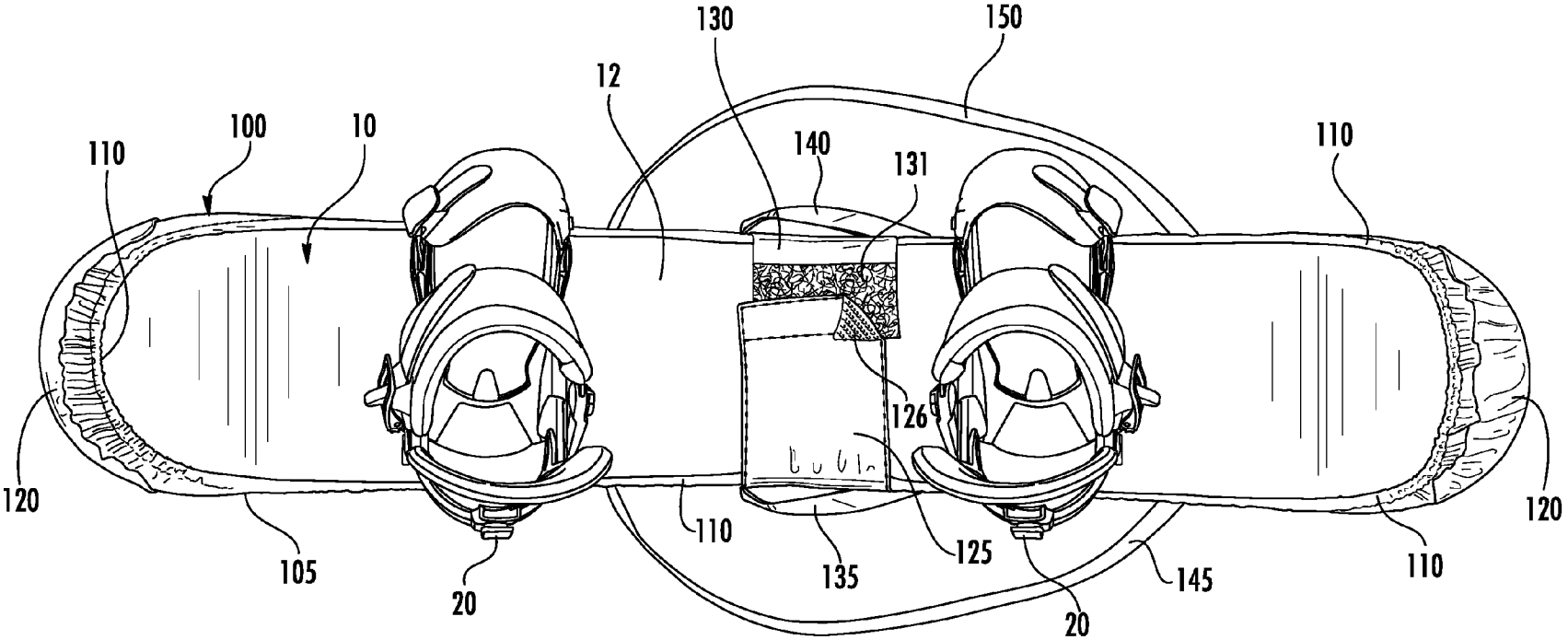
FIG. 2 is a top plan view of the embodiment of the present invention as shown in FIG. 1.

The cover 105 is also held in place by a first strap 125 and a second strap 130 that connect to each other via a hook and loop connection. As shown in FIGS. 1-5, the first strap 125 and the second strap 130 are depicted as being sewn to the outer surface of the cover 105. However, it should be noted that the first strap 125 and the second strap 130 may be attached to the cover 105 using alternate means, such as, but not limited to adhesive bonding or stapling. Alternatively, the first strap 125 and the second strap 130 may be formed as part of the cover 105 during manufacture. As shown in FIG. 2, a piece of hook material 126 is attached to the interior surface of the first strap 125. A piece of loop material 131 is attached to the exterior surface of the second strap 130. The hook material 126 and the loop material 131 may be attached to their respective straps by any of a number of means, such as, but not limited to, adhesive bonding, sewing, or stapling.

Figure 3:
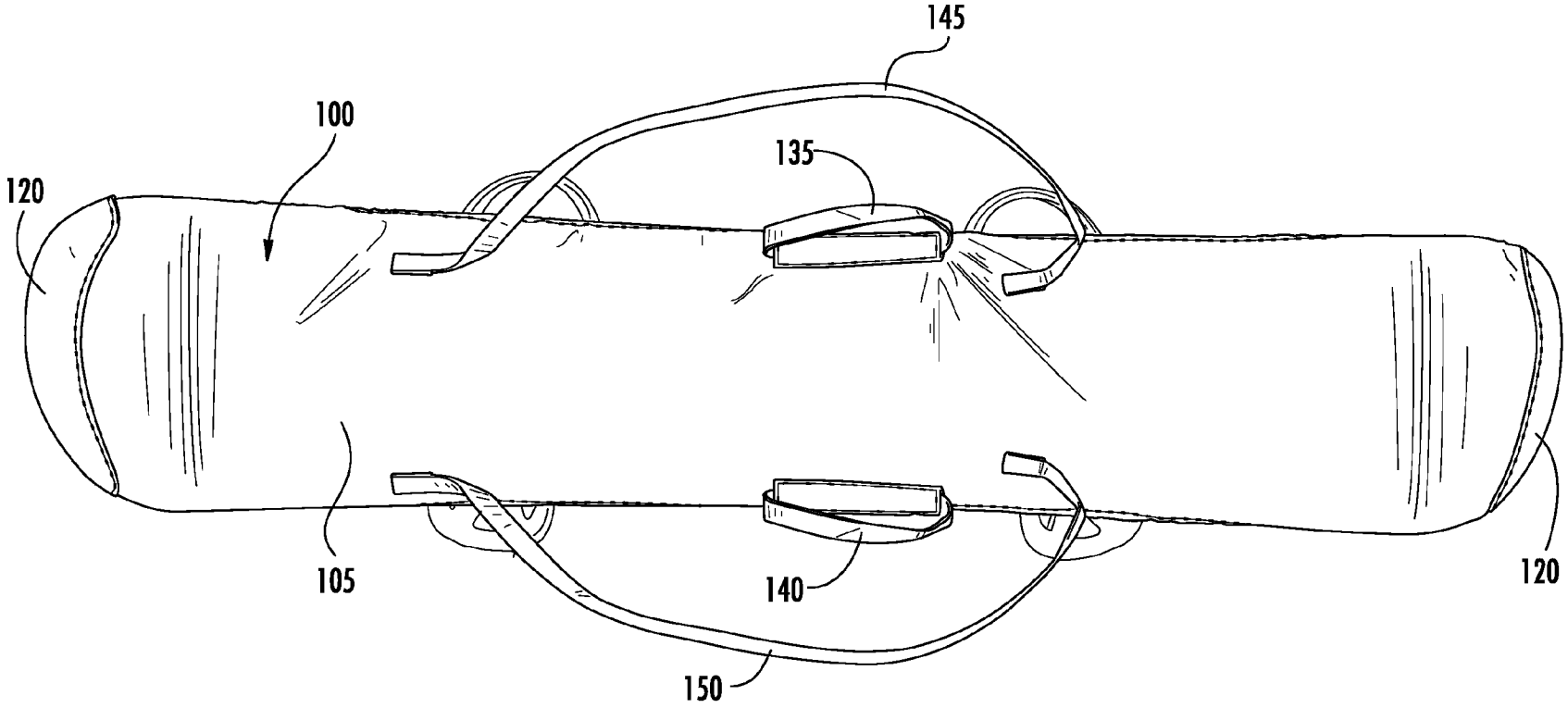
FIG. 3 is a bottom plan view of the embodiment of the present invention as shown in FIG. 1.
Figure 4:
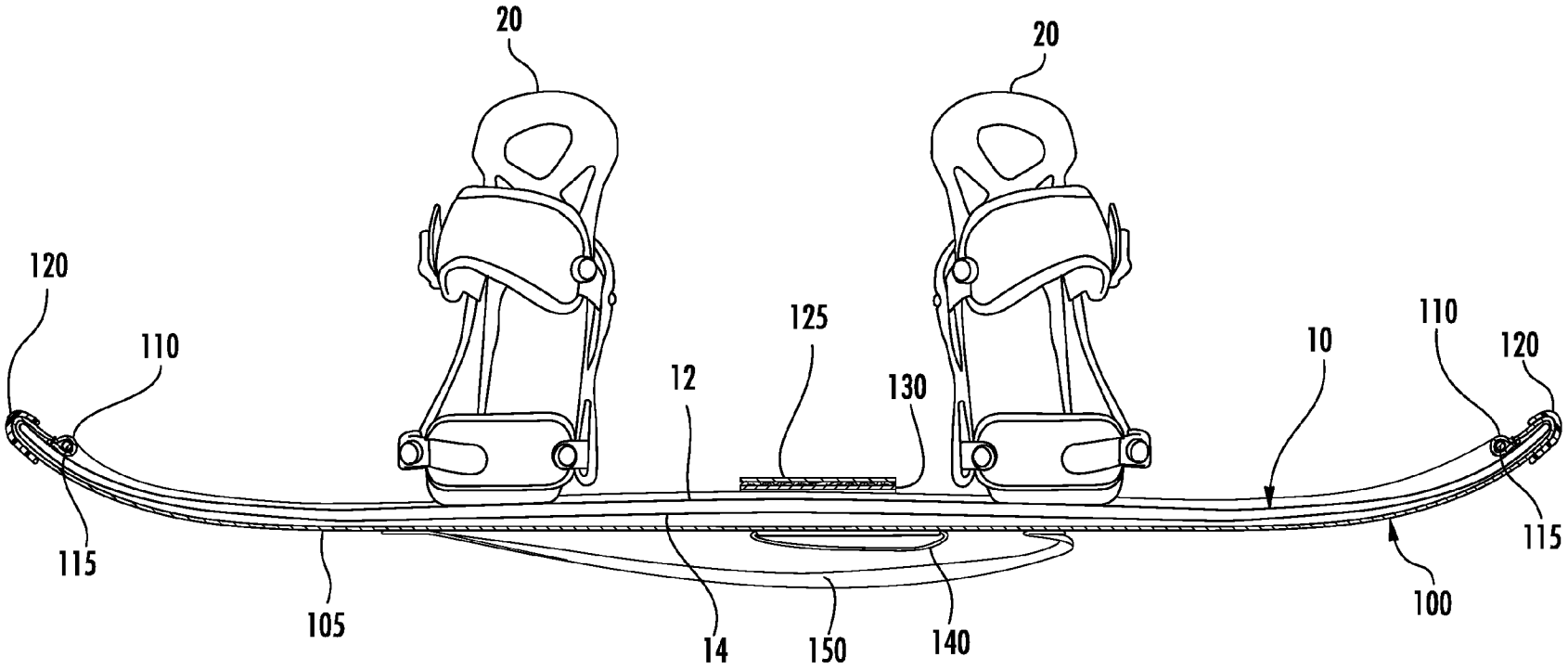
FIG. 4 is a cross sectional view taken about lines 4-4 of FIG. 1.
Figure 5:
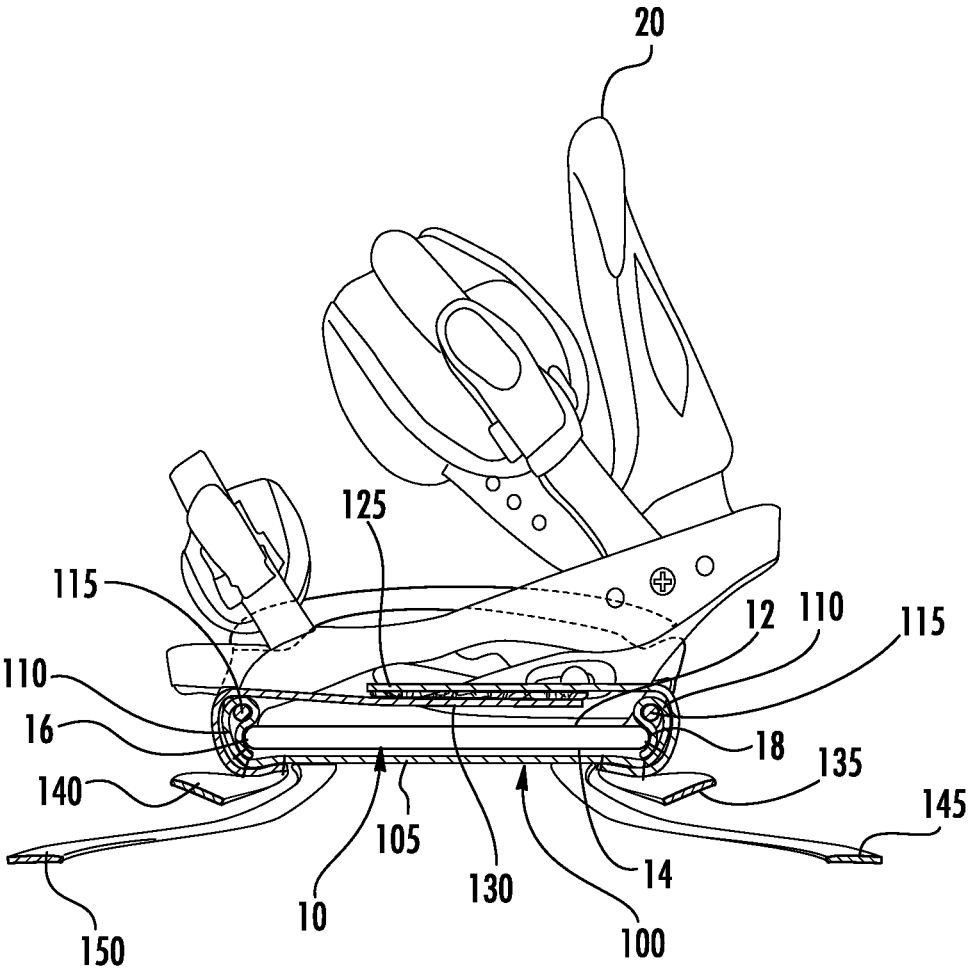
FIG. 5 is a cross-sectional view taken about lines 5-5 of FIG. 1.

The collapsible carrying case cover 100 further comprises a plurality of carrying handles and carrying straps. Referring again to FIGS. 1-5, the collapsible carrying case cover 100 includes a first carrying handle 135 and a second carrying handle 140. The first and second carrying handles 135, 140 allow a user to carry the collapsible carrying case cover 100, when in assembled relation to a snowboard, like a briefcase. The first and second carrying handles 135, 140 may be attached to the cover 105 on a bottom surface at approximately the center of the cover 105, as shown in FIG. 3. Alternatively, the first and second carrying handles 135, 140 may be attached to the cover 105 on a side surface or top surface. The first and second carrying handles 135, 140 may be attached to the cover 105 by any of a number of means, such as, but not limited to, adhesive bonding, sewing, stapling, or a removable system such as snap or clasp. Preferably, the first and second carrying handles 135, 140 are constructed of a flat nylon tape. However, the first and second carrying handles 135, 140 may be constructed of any number of materials, or combination of materials, such as, but not limited to, spandex, polyester, neoprene, and nylon. The first and second carrying handles 135, 140 may also be constructed of molded plastic, and may include an ergonomic gripping portion.

Referring again to FIGS. 1-5, the collapsible carrying case cover 100 includes a first carrying strap 145 and a second carrying strap 150. The first and second carrying straps 145, 150 allow a user to carry the collapsible carrying case cover 100, when in assembled relation to a snowboard, like a backpack. The first and second carrying straps 145, 150 may be attached to the cover 105 on a bottom surface, as shown in FIG. 3. Alternatively, the first and second carrying straps 145, 150 may be attached to the cover 105 on a side surface or even a top surface of the cover 105. The first and second carrying straps 145, 150 may be attached to the cover 105 by any of a number of means, such as, but not limited to, adhesive bonding, sewing, stapling, or a removable system such as snap or clasp. The first and second carrying straps 145, 150 may also include strap adjusters (not shown) that allow the first and second carrying straps 145, 150 to be modified to fit users of various sizes.

Referring to FIGS. 6-8, the collapsible carrying case cover 100, when in unassembled relation to a snowboard, may be collapsed into a fully collapsed configuration, as shown in FIG. 8. Referring to FIG. 6, when the collapsible carrying case cover 100 is removed from a snowboard, it may be flipped inside out. The collapsible carrying case cover 100 is flipped inside out so that the first and second carrying straps 145, 150 are on the interior of the fully collapsed configuration and will not be exposed when in the fully collapsed configuration. The outer ends of the cover 105 may be rolled upon themselves toward the first and second straps 125, 130 of the cover 105. FIG. 6 depicts the cover in a partially rolled configuration. Each outer end of the cover 105 may be rolled until the cover 105 is in a fully rolled configuration, as shown in FIG. 7. The cover 105 in fully rolled configuration may be held in place by the first strap 125 and the second strap 130 that connect to each other via a hook and loop connection, as shown in FIG. 8, forming the fully collapsed configuration. As shown in FIG. 8, the second carrying handle 140 is left exposed in the fully collapsed configuration by pulling the second strap 130 through the second carrying handle 140 before attaching the first and second straps 125, 130. The exposed second carrying handle 140 is advantageous as it allows a user to easily carry the collapsible carrying case cover 100 or attach the collapsible carrying case cover 100 to another item via an attachment means such as a clip or clasp. In addition, the second carrying handle 140, when exposed, allows for a retailer to easily and conveniently display the collapsible carrying case cover 100.

A user may utilize the collapsible carrying case cover 100 as a protection device when in a fully collapsed configuration. The collapsible carrying case cover 100 when in a fully collapsed configuration may be worn by a user over the user's coccyx bone to add further padding and protection from falls.

Having thus described various embodiments of the collapsible carrying case cover in detail, it is to be appreciated and will be apparent to those skilled in the art that many changes, only a few of which are exemplified in the detailed description above, could be made in the device without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A collapsible carrying case cover for use with board sports equipment having an expanded configuration and a fully collapsed configuration, comprising:

a cover of the collapsible carrying case cover that is configured to completely cover a bottom surface and edges of the board sports equipment and to extend upwardly and inwardly about a perimeter of the board sports equipment to partially cover a top surface of the board sports equipment;

a peripheral edge that continuously extends around the periphery of the cover of the collapsible carrying case cover;

an elastic cord disposed in a channel formed in the peripheral edge; wherein the elastic cord is configured to draw the peripheral edge inwardly when in assembled relation to the board sports equipment;

a first strap and a second strap attached to an outer surface of the cover of the collapsible carrying case cover; wherein the first strap is configured to attach to the second strap via a hook and loop fastener over the top surface of the board sports equipment;

a first carrying handle and a second carrying handle attached to the cover of the collapsible carrying case cover at opposing sides of the cover of the collapsible carrying case cover;

a first carrying strap and a second carrying strap attached to a bottom surface of the cover of the collapsible carrying case cover;

wherein the collapsible carrying case cover is configured to collapse into the fully collapsed configuration when in unassembled relation to the board sports equipment; and wherein in the fully collapsed configuration, the cover of the collapsible carrying case cover is inside out and outer ends of the cover of the collapsible carrying case cover are rolled upon themselves toward the first strap and the second strap.

2. The collapsible carrying case cover of claim 1, further comprising:

a first additional protective covering attached to the cover of the collapsible carrying case cover, wherein the first additional protective covering is configured to protect a toe portion of the board sports equipment.

3. The collapsible carrying case cover of claim 1, further comprising:

a second additional protective covering attached to the cover of the collapsible carrying case cover, wherein the second additional protective covering is configured to protect a heel portion of the board sports equipment.

4. The collapsible carrying case cover of claim 1, wherein the cover of the collapsible carrying case cover is constructed of a fabric that includes spandex and polyester.

5. The collapsible carrying case cover of claim 1, wherein the cover of the collapsible carrying case cover is capable of being stretched along both its length and width.

6. The collapsible carrying case cover of claim 1, wherein in the fully collapsed configuration, the first strap and second strap are configured to attach to each other via the hook and loop fastener over the rolled outer ends of the cover of the collapsible carrying case cover.

7. The collapsible carrying case cover of claim 6, wherein in the fully collapsed configuration, at least one of the first carrying handle and second carrying handle is exposed.

* * * * *